United States Patent [19]

Walker et al.

[11] 4,077,143

[45] * Mar. 7, 1978

[54] STEAM IRON

[75] Inventors: Wendell C. Walker, Alta Loma; William E. Davidson, Ontario; Kaj Toft, Upland, all of Calif.

[73] Assignee: General Electric Company, Bridgeport, Conn.

[ * ] Notice: The portion of the term of this patent subsequent to Mar. 25, 1992, has been disclaimed.

[21] Appl. No.: 527,210

[22] Filed: Nov. 26, 1974

Related U.S. Application Data

[63] Continuation of Ser. No. 424,570, Dec. 13, 1973, abandoned.

[51] Int. Cl.[2] ..... D06F 75/06

[52] U.S. Cl. ..... 38/77.83

[58] Field of Search ..... 38/77.5; 38/77.7; 38/77.8; 38/77.83; 38/77.9

[56] References Cited

U.S. PATENT DOCUMENTS

| | | | |
|---|---|---|---|
| 3,599,357 | 8/1971 | Gronwick | 38/77.83 |
| 3,711,972 | 1/1973 | Risacher | 38/77.83 |
| 3,722,117 | 3/1973 | Davidson | 38/77.83 |
| 3,820,259 | 6/1974 | Flowers | 38/77.83 |
| 3,828,452 | 8/1974 | Eaton et al. | 38/77.83 |

*Primary Examiner*—Patrick D. Lawson

*Attorney, Agent, or Firm*—John F. Cullen; George R. Powers; Leonard J. Platt

[57] ABSTRACT

A steam iron having an interior water tank and steam generating soleplate with a loop-shaped heating element therein and steam ports in the soleplate. An improvement in steam generating capacity is provided of a main generator inside the loop fed by a metering water valve and directly connected to first distributing passage means supplying steam to the ports. A separate soleplate generator is supplied separately from the main generator on the outside of the loop and a second circuitous separate passage means extends generally parallel to and over the heating element with the separate passage means being completely separate from the distributing passage and later connecting to it. Restrictive direction flow means are provided in the circuitous passage which may be S-shaped and spanning the heating element and pump means is provided to selectively inject water into the separate generator for flashing into steam in the circuitous passage and then exit the ports after passing through the distributing passage in a hybrid system to increase the steam generating capacity and provide for an extra surge of steam when required.

7 Claims, 3 Drawing Figures

STEAM IRON

This is a continuation, of application Ser. No. 424,570, filed Dec. 13, 1973, now abandoned.

BACKGROUND OF THE INVENTION

1. Field of the Invention

The invention herein pertains to a steam iron with separate generating means that may be pump-fed to provide extra steam capacity or a surge of steam through the normal soleplate ports when extra steam is required.

2. Description of the Prior Art

With the advent of irons using water for either steam or spray or both, a water tank is provided in the iron above the soleplate and water valve structure is provided for metered drippage of water into a steam generator where it is evaporated and flashed into steam and directed out ports in the soleplate to steam the article. Additionally, irons have been provided with both manual and power spray attachments so that some of the tank water may be sprayed out of the nose of the iron to dampen the fabric. In order to provide extra steam capacity, some irons provide means whereby an extra slug of water may be pumped into the steam generating area, usually into a separate chamber, the entire steam generating system being within the confines of the heating element, whereupon the extra steam and main steam are both fed directly into the main distribution system after passage through a tortuous system or the extra steam may be passed first through the main generator and then into the distribution system to exit the soleplate ports as extra capacity steam. Such systems are shown in U.S. Pat. Nos. 3,599,357 and 3,711,972, respectively. Another system, as shown in U.S. Pat. No. 3,703,043, allows the generated steam to be shifted from one group of soleplate ports to another group of ports so that the steam exits vigorously through few ports or softly through many ports depending on the needs of the fiber being ironed. The present invention is another form or hybrid system whereby an extra surge of steam may be efficiently obtained in order to increase the steam capacity of the iron on demand. A further arrangement using completely separate systems is shown in concurrently-filed application Ser. No. 424,568, filed Dec. 13, 1973 of common assignment.

SUMMARY OF THE INVENTION

Briefly described, the present invention is directed to a steam iron having an interior water tank and a steam generating soleplate with a loop-shaped heating element therein and the soleplate being supplied with steam ports. The invention improves on the steam generating capacity by providing a main flash soleplate generator inside of the loop, the generator being fed by a metering water valve, and directly connected to a first distributing passage means directly supplying the steam to the ports. A separate soleplate steam generator is supplied separate from the main generator on the outside of the loop and a second circuitous separate passage means, that is completely separate from the distributing passage means, is provided and later connected to the distributing passage means. Plural restrictive directing flow means are provided in the circuitous passage and a pump means selectively injects water into the separate generator so it flashes into steam in crossing the heating element and passes through the circuitous passage whereby the steam later enters the distributing passage to exit the soleplate ports as an extra surge of steam in a hybrid system. The separate passage means and separate generator may be symmetrical about the soleplate centerline and the separate generator is preferably disposed in the nose of the iron and substantially inboard of the first passage means. Thus, the main object of the invention is to disclose a steam iron with improved means to provide extra steam capacity for an extra surge of steam on demand.

BRIEF DESCRIPTION OF THE DRAWING

Referring to FIG. 1, there is shown an electric steam iron of the general type normally used with a manual spray as shown in U.S. Pat. No. 3,183,611 of common assignment, although the manual diaphragm pump used herein provides extra water to the soleplate to increase its steam generating capacity as will be explained instead of directing it to a sprayer. Also, suitable valving, as generally shown in said U.S. Pat. No. 3,599,357 patent, could provide both functions of a spray and/or extra steam if desired. As shown in FIG. 1, the iron includes a soleplate 10 having a plurality of steam ports 12 and outer shell 14 connected in any suitable manner to handle 16 all in known fashion. In accordance with conventional practice, soleplate 10 may be made from a suitable material such as cast aluminum, with an electrical loop-shaped heating element 18 cast in position. This heating element preferably is of the sheath type and, with an electrical resistance element, extends through an outer tubular protective sheath with the heating element separated from the outer sheath by an insulating compound resistant to heat such as granulated and compressed magnesium oxide. The heating element generally extends in a loop beginning at the rear of the iron and along one side to the forward end and across the nose of the iron and then rearwardly along the other side. Thus, substantially uniform heat distribution is provided when the iron is plugged in and activated.

Figure 1:
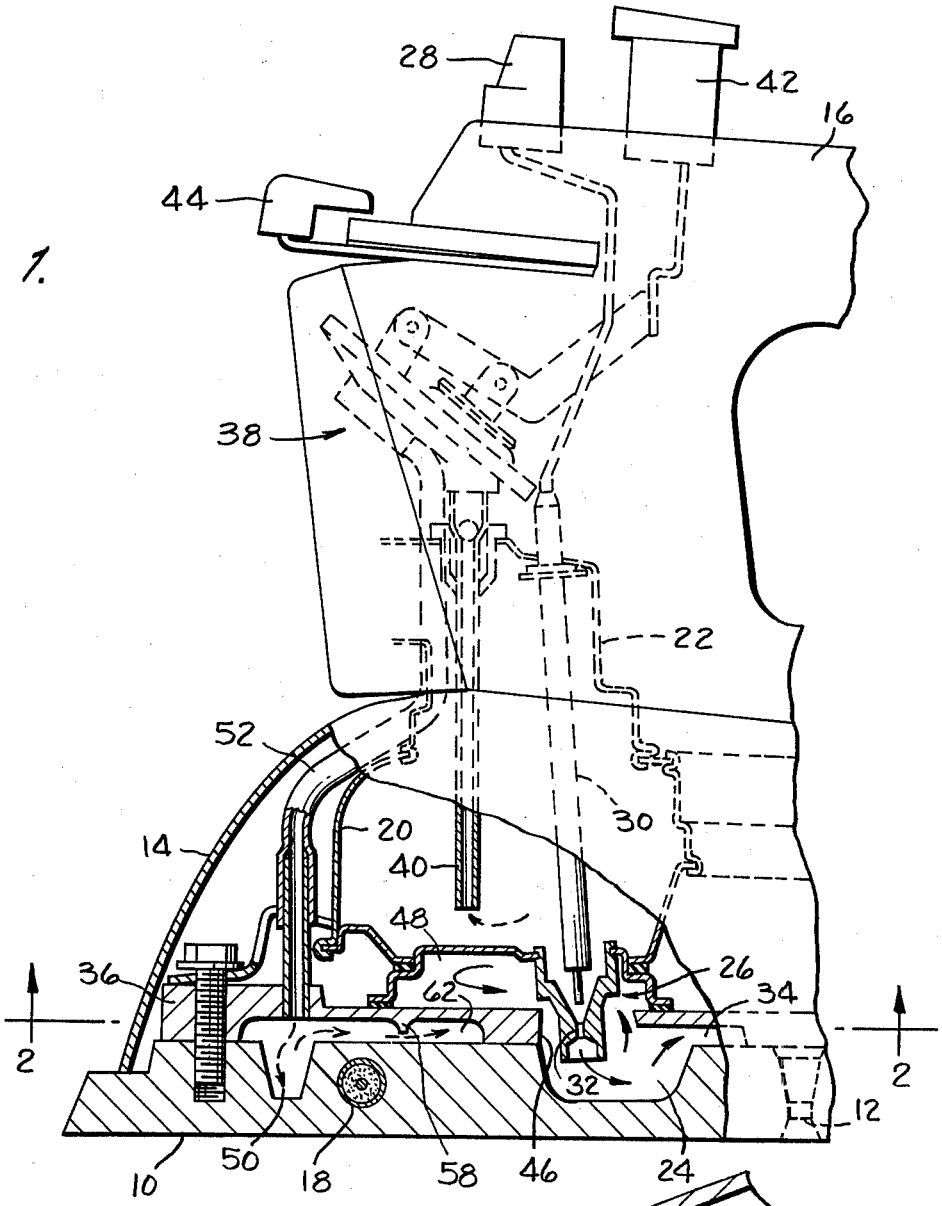
FIG. 1 is a partial elevational cross-sectional and broken view of a typical steam iron partly showing the invention.

The iron, which may be pressurized or not, includes means for generating steam by providing water tank 20 with vertical outer riser tube means 22 in the forward portion for housing various operating mechanisms as is well-known. For steam, soleplate 10 has a main flash soleplate generator 24 into which water is dripped under control of a metering water valve, generally indicated at 26, and including a handle mounted button 28 and connected spring-biased vertical stem 30. The water dripped through orifice 32 from tank 20 onto the heated soleplate flashes into steam which is distributed directly into first distributing passage means 34 under coverplate 36 and then out ports 12 to the ironing surface as shown by the solid arrows. The invention is also applicable to steam-powered spray irons as typically shown in U.S. Pat. No. 3,041,757 of common assignment but the present invention is directed to an iron that uses manual spray pump structure of the general type shown in U.S. Pat. No. 3,183,611 supra. In such an arrangement, a diaphragm pump 38 communicates with tank 20 by means of water or inlet tube 40 which extends vertically from the bottom portion of the tank through its top and into the pump. The pump is actuated by a separate handle control 42 so that water may be sucked up from the tank and discharged to a point of use. Temperature control 44 operates in a known manner to thermostatically control the heat generated in the soleplate. Thus, when button 28 is in the "up" or steam position as shown, water drips into generator 24 and then flashes into steam and enters the first distributing passage means 34 and thus directly supplies steam to soleplate ports 12 in the conventional fashion. Steam also passes through opening 46 and collects in dome portion 48 and migrates to the same distributing passage means, the dome being shown simply because it is structure common to several spray irons and can support a balance tube as shown at 16 in the U.S. Pat. No. 3,041,757 patent. In the present structure, the dome is capped and all the steam passes directly into the first distributing passages 34 and to the soleplate ports 12. This structure thus far described, when the diaphragm pump 38 is used for spray, is generally well-known in steam irons.

Figure 2:
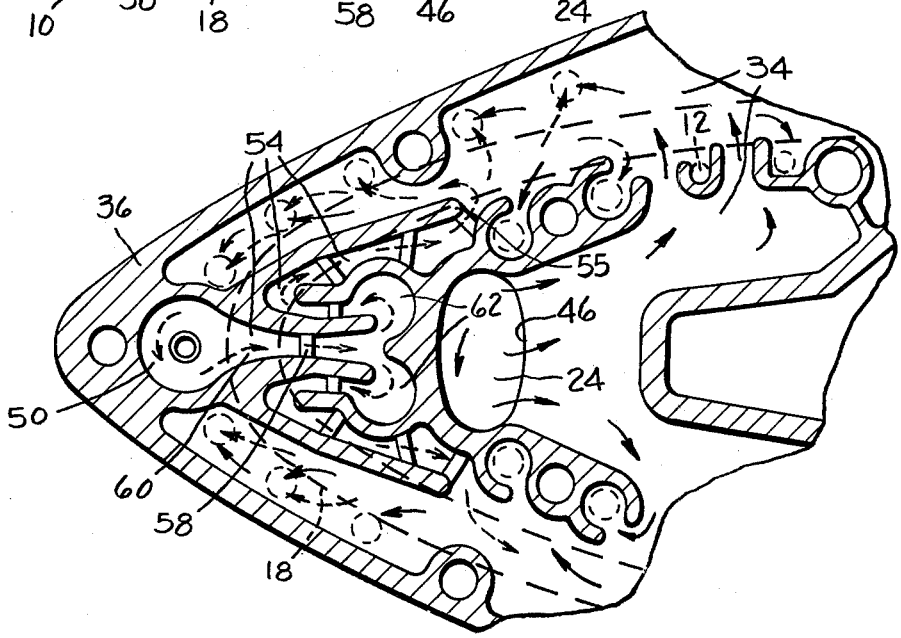
FIG. 2 is a partial plan view of the underside of the iron coverplate in the direction of line 2—2 of FIG. 1 showing the arrangement of passage means with an outline of the heating element and soleplate ports superimposed.
Figure 3:
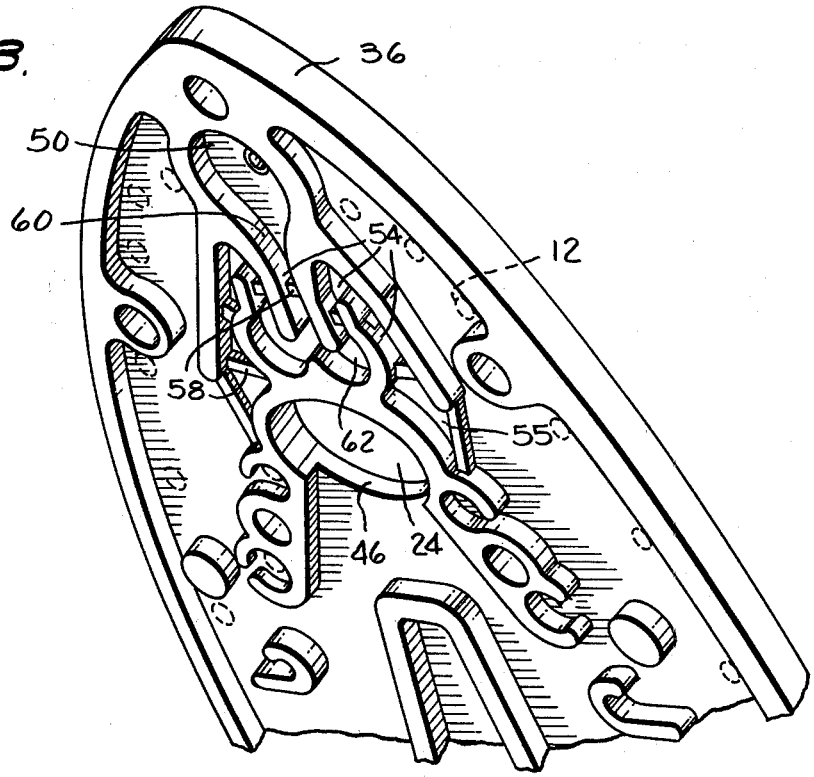
FIG. 3 is a similar partial perspective of the structure shown in FIG. 2.

In order to provide extra capacity steam in a unique and efficient manner for various difficult jobs or touch-up purposes, it is desirable to provide an extra slug of water over and above the usual metering valve means so that more steam may be obtained as an extra surge on demand. To this end, there is provided a separate soleplate steam generator 50 separate from the main generator 24 in the nose of the iron. While not actually seen in FIGS. 2 or 3, since they are below the underside of coverplate 36, generator numerals 24 and 50, the soleplate ports 12, and heating element 18 are all selectively shown for better understanding since they are directly below as seen in FIG. 1. This second generator 50 is fed from diaphragm pump 38 through any suitable connector 52 to selectively inject an additional slug of water into generator 50. Connector 52 is simply connected to the discharge end of pump 38 and may be directed to a point feeding generator 50 either through the water tank 20 for an internal surge hook-up or around it as shown in FIG. 1 depending on space limitations. In order to convert the slug of water in generator 50 into steam efficiently as shown by the dotted arrows, a second circuitous passage means generally indicated at 54 is provided separate from passage means 34, meaning it is completely circuitous before connecting at 55 to the distributing passage means 34 after a substantial distance in the general area of the main generator as shown in FIG. 3. It should be noted that second circuitous passage 54 has no outlets to the soleplate and this is to ensure that all of the water is converted to steam before it is distributed in this hybrid form of system to and then through main passage 34 and to convert it without going into or through the main generator 24 as seen in FIGS. 2 and 3. The two generators 50 and 24 are preferably disposed on opposite sides of the heating element 18 with main generator 24 being inside the loop of the heating element and the second generator 50 being on the outside of the loop. The extra water is thus brought into generator 50 outside the heating element and turned to steam and gets the effect of a large heat sink area by crossing over the heating element and then generally extending parallel to and over the top of the heating element as shown in FIG. 2 with the entire secondary system of generator 50, and its circuitous passage 54 being disposed substantially inboard of the first distributing passage means 34 and connected to it without going through the main generator.

In order to utilize the hottest point of the heating element to form steam, it is useful, in the nose area of the loop, to provide the circuitous passage 54 in the form of an S or reverse flow path before it connects to enter the first passage means 34 as shown in FIG. 2. The circuitous passage 54 is provided with plural restrictions, in the form of projections 58, to repeatedly squeeze the water and direct it and steam, as shown, toward the sole plate in the hottest area as they pass the projections for efficient and rapid conversion to steam. In addition, the throat area 60 is designed to both direct the water passing over the heating element into swirl chambers 62 and thence along circuitous passage 54 to empty into the first passage means 34.

To make the configuration as streamlined as possible and eliminate restrictions to good steam flow, the entire hybrid design is a symmetrical arrangement about the center line of the soleplate. Thus, the circuitous separate passage 54 and separate generator 50 are disposed symmetrically about the center line as shown in FIG. 2 and, as previously noted, generally inboard of the first passage means 34 that extends generally along the periphery of the iron soleplate. The reverse flow in passage means 54 at the S takes place in the hot portion of the iron where all the fluid is squeezed, directed toward the sole plate by the projections 58 and is converted to steam in the circuitous passage and then enters passage means 34 for distribution to the soleplate ports as an extra surge of steam without passing through or into the main steam generator area thus ensuring the surge ability even if the main generator area should clog.

The separate handle controls in the form of buttons 28 and 42 are disposed to selectively and independently feed water to the generators 24 and 50 respectively for regular or an extra surge of steam as required. It will be apparent that the normal or main steam flow is directly into the distributing passage means 34 and then out the soleplate ports with no back flow into the circuitous passage 54 since there is no place for it to go and because of the pressure restrictions so all the normal flow effectively bypasses the circuitous passage and directly exits the ports. Also, the extra surge of steam enters the main distribution system well downstream after it has been completely converted to steam and then exits through the same ports each being operable separately if the other is incapacitated.

The steam iron structure shown provides an efficient means for obtaining extra capacity for more steam conversion in the hottest part of the iron over the heating element and a cross-over arrangement between separate and spaced generators where the separate extra steam generator feeds a separate circuitous passage generally parallel to and over the heating element while directing the fluid towards the hot sole plate and then empties into the main distributing passage and thence out soleplate ports for rapid and extra steam on demand. Thus, the surge system is located in the hottest part of the iron.

While there has been shown a preferred form of the invention, obvious equivalent variations are possible in light of the above teachings. It is therefore to be understood that, within the scope of the appended claims, the invention may be practised otherwise than as specifically described, and the claims are intended to cover such equivalent variations.

We claim:

1. In a steam iron having an interior water tank and a steam generating soleplate with ports therein, the improvemen in steam generating capacity comprising:

a main flash soleplate generator fed by a metering water valve and directly connected to first distributing passage means supplying steam to said ports, a separate soleplate steam generator separate from said main generator, second circuitous separate passage means connecting the separate generator to the distributing passage means without passing through said main generator, restrictive means in said circuitous passage directing steam and water towards the soleplate, pump means operative to selectively inject water into the separate generator where it completely flashes into steam in the circuitous passage and then enters the distributing passage to exit said ports, and said separate generator and circuitous passage means being disposed inboard of said first passage means.

2. Apparatus as described in claim 1 wherein said circuitous separate passage means is formed to provide a reverse flow before entering said first passage means.

3. Apparatus as described in claim 2 wherein separate handle controls are disposed to selectively and independently feed water to said generators.

4. In a steam iron having an interior water tank and a steam generating sole plate with a loop-shaped heating element therein and the sole plate having ports therein, the improvement in steam generating capacity comprising, a main flash sole plate generator inside of the loop fed by a metering water valve and directly connected to first distributing passage means supplying steam to said ports, a separate sole plate steam generator separate from said main generator on the outside of the loop, second circuitous separate passage means extending substantially parallel to and over the heating element and being completely circuitous before connecting to said distributing passage means and without passing through said main generator, plural restrictive flow means in said circuitous passage repeatedly directing passing steam and water toward the hot sole plate, and pump means operative to selectively inject water into the separate generator to completely flash into steam in the circuitous passage and then enter the distributing passage to exit said ports.

5. Apparatus as described in claim 4 wherein said separate generator is disposed in the nose of said iron and it and said circuitous separate passage means are both disposed inboard of said first passage means and symmetrically about the soleplate centerline.

6. Apparatus as described in claim 5 wherein said circuitous separate passage means is formed to provide an S-flow path in the nose area of said loop before entering said first passage means.

7. Apparatus as described in claim 6 wherein separate handle controls are disposed to selectively and independently feed water to said generators.

* * * * *